US011085105B2

(12) United States Patent
Zheng et al.

(10) Patent No.: US 11,085,105 B2
(45) Date of Patent: Aug. 10, 2021

(54) MG—GD—Y—ZN—ZR ALLOY AND PROCESS FOR PREPARING THE SAME

(71) Applicant: THE BOEING COMPANY, Chicago, IL (US)

(72) Inventors: Mingyi Zheng, Harbin (CN); Yuanqing Chi, Harbin (CN); Ding Sun, Harbin (CN); Xiaoguang Qiao, Harbin (CN); Hansi Jiang, Harbin (CN)

(73) Assignee: THE BOEING COMPANY, Chicago, IL (US)

( * ) Notice: Subject to any disclaimer, the term of this patent is extended or adjusted under 35 U.S.C. 154(b) by 83 days.

(21) Appl. No.: 16/468,238

(22) PCT Filed: Dec. 5, 2017

(86) PCT No.: PCT/CN2017/114605
§ 371 (c)(1),
(2) Date: Jun. 10, 2019

(87) PCT Pub. No.: WO2018/103632
PCT Pub. Date: Jun. 14, 2018

(65) Prior Publication Data

US 2020/0102631 A1 Apr. 2, 2020

(30) Foreign Application Priority Data

Dec. 10, 2016 (CN) ..... 201611133731.9

(51) Int. Cl.
*C22C 23/06* (2006.01)
*C22C 1/03* (2006.01)
*C22F 1/06* (2006.01)

(52) U.S. Cl.
CPC ..... *C22C 23/06* (2013.01); *C22C 1/03* (2013.01); *C22F 1/06* (2013.01)

(58) Field of Classification Search
CPC ... C22C 23/06; C22C 1/03; C22C 1/02; C22F 1/06
See application file for complete search history.

(56) References Cited

U.S. PATENT DOCUMENTS

2011/0229365 A1 9/2011 Lyon et al.

FOREIGN PATENT DOCUMENTS

| | | | | |
|---|---|---|---|---|
| CN | 101003875 | A | | 7/2007 |
| CN | 101153361 | A | | 4/2008 |
| CN | 101191168 | A | | 6/2008 |
| CN | 102392166 | A | | 3/2012 |
| CN | 104195397 | A | * | 12/2014 |
| CN | 104195397 | A | | 12/2014 |
| CN | 104651694 | A | * | 5/2015 |
| CN | 106756370 | A | | 5/2017 |
| WO | 2016103632 | A1 | | 6/2018 |

OTHER PUBLICATIONS

CN-104651694-A English Translation, Ding Wenjiang, from Espacenet, 2015 (Year: 2015).*
PCT Written Opinion of the International Searching Authority for Application No. PCT/CN2017/114605 dated Jan. 30, 2018.
PCT International Search Report for Application No. PCT/CN2017/114605 dated Feb. 5, 2108.

* cited by examiner

*Primary Examiner* — Anthony J Zimmer
*Assistant Examiner* — Jacob James Gusewelle
(74) *Attorney, Agent, or Firm* — Patterson + Sheridan, LLP

(57) ABSTRACT

The present disclosure discloses a Mg—Gd—Y—Zn—Zr alloy which, in embodiments, includes high strength, toughness, corrosion resistance and anti-flammability. The disclosure includes a process for preparation thereof. Components and mass percentages in the Mg—Gd—Y—Zn—Zr alloy are: 3.0%≤Gd≤9.0%, 1.0%≤Y≤6.0%, 0.5%≤Zn≤3.0%, 0.2%≤Zr≤1.5%, the balance being Mg and inevitable impurities. The process for preparation thereof comprises: adding pure Mg into a smelting furnace for heating, then introducing mixed gases of $CO_2$ and $SF_6$ into the furnace for protection; adding other raw materials in sequence when the pure Mg is completely melted; preparing an ingot; conducting a homogenization treatment on the ingot prior to extrusion; conducting an aging treatment on the extruded alloy. The present disclosure includes a wrought magnesium alloy having both superior overall performances, good fracture toughness, corrosion resistance and anti-flammability, with a small amount of rare earth element by adjusting the proportion of the alloy elements and by conventional casting, extrusion and heat treatment processes.

21 Claims, No Drawings

MG—GD—Y—ZN—ZR ALLOY AND PROCESS FOR PREPARING THE SAME

CROSS-REFERENCE TO RELATED APPLICATIONS

This application is a U.S. National Stage Entry of PCT application PCT/CN2017/114605, filed Dec. 5, 2017, which claims priority to Chinese Patent Application No. 201611133731.9, filed Dec. 10, 2016. The aforementioned patent applications are herein incorporated by reference in their entirety.

TECHNICAL FIELD

The present invention belongs to the metal materials and metallurgical field.

BACKGROUND OF ART

The magnesium alloy described herein has many advantages, such as low density, high specific strength, high specific stiffness, excellent damping performance and good castability. A boom in the development and application of magnesium alloys began in the 1990s. The magnesium alloy has a wide prospect of application in aerospace, automobile, high-speed rail, and 3C fields. However, the absolute strength of known magnesium alloys is low, and the plasticity, flame retardant property and corrosion resistance are poor, which limits the large-scale application of magnesium alloys. Therefore, it is desirable to develop a magnesium alloy with excellent overall performances.

Kawamura et al. teaches preparation of an ultra-high strength $Mg_{97}Zn_1Y_2$ alloy with the room-temperature yield strength greater than 600 MPa by employing rapid solidification and powder metallurgy technology. However, the preparing process greatly increases the preparation difficulty and cost, which limits the wide application of the alloy. Homma et al. teaches preparation of rare-earth-containing magnesium alloys with excellent mechanical properties by employing conventional casting, extrusion and heat treatment processes, the tensile strength and yield strength thereof at room temperature are 542 MPa and 473 MPa, respectively, and elongation of 8%. However, the rare-earth content in this alloy reaches up to 16 wt. %, and this not only increases the material cost, but also increases the density of the alloy, which weakens the advantage of the magnesium alloy as a light material. Jian et al. teaches adding 1.8 wt. % Ag into Mg—Gd—Y—Zr alloy prior to rolling deformation, and the room-temperature tensile strength and yield strength of the alloy reaches 600 MPa and 575 MPa, respectively, meanwhile, the elongation is 5.2%. However, the addition of Ag in a high content results in a significant increase in the material cost, while the corrosion resistance of the alloy also decreases, which is not beneficial for the practical application of the magnesium alloy. In addition, as compared with other common metal materials, the magnesium alloys generally have a lower ignition point. Such a relative strong inflammability hinders the applications of magnesium alloys in many fields, especially in the aerospace field.

The patent application No. CN201110282459.1 discloses a magnesium alloy with high toughness and high yield strength. After homogenization treatment, extrusion and aging treatment, the tensile strength of the alloy can reach to 360 MPa, the yield strength can reach to 330 MPa, and the elongation can reach to 11%. The patent application No. CN201110340198.4 discloses a high-strength and heat-resistant magnesium alloy with low rare earth content and its preparation method". After homogenization treatment, extrusion and aging treatment, the alloy exhibits a tensile strength ≥250 MPa, and an elongation ≥8%. The patent application No. CN200510025251.6 discloses a high-strength and heat-resistant magnesium alloy and its preparation method. The magnesium alloy in T5 state can exhibit a tensile strength ≥369 MPa, a yield strength ≥288 MPa, and an elongation ≥5.1%. The mechanical properties of the rare-earth containing magnesium alloys involved in the above patents are relatively low, and it is difficult to apply them in bearing components in a large amount.

The patent application No. CN201210164316.5 discloses a high-strength Mg—Gd—Y—Zn—Mn alloy. After homogenization treatment, extrusion and heat treatment, the alloy can exhibit a tensile strength ≥428 MPa, a yield strength ≥241 MPa, and an elongation ≥7.7%. The patent application No. CN201410519516.7 discloses preparation and treatment processes of a Mg—Gd—Y—Zr alloy. After T5 treatment, the highest mechanical properties thereof are: a tensile strength of 403 MPa, a yield strength of 372 MPa, and an elongation of 4.4%. The patent application No. CN201610122639.6 discloses a Mg—Gd—Y—Ni—Mn alloy with high strength and high plasticity and its preparation method. Its highest mechanical properties can reach to a tensile strength ≥450 MPa, and an elongation ≥9.0%, but the rare-earth content of the alloys listed in this patent are about 12%, leading to a high density. The rare-earth content of the alloys also adds to the cost. The patent application No. CN201010130610.5 discloses a flame-retardant magnesium alloy containing Gd, Er, Mn and Zr, wherein its flame retardant temperature can reach to 740° C., the room-temperature tensile strength of the cast alloy can reach to 220 MPa, and the elongation is larger than 5%. The patent application No. CN201210167350.8 discloses a flame-retardant magnesium alloy, wherein the elements such as Ca, Sr, Re, and Be are added into AZ91D alloy, such that the ignition point of the material is increased to 710° C. The patent application No. CN201410251364.7 discloses a flame-retardant and high-strength magnesium alloy and its preparation method, wherein the alloy has a composition of Mg—Al—Y—CaO, a flame retardant temperature ≥745° C., and a room-temperature tensile strength ≥231 MPa. These alloys involved in the above patents have poor mechanical properties, thus limiting their application and development.

The corrosion resistance of the current commercial magnesium alloys is poor, and the corrosion rate of AZ31 magnesium alloy is about 4.5 $mg \cdot cm^{-2} \cdot d^{-1}$. In the patent application No. CN201010120418.8, the corrosion rate thereof can be reduced to as low as 0.98 $mg \cdot cm^{-2} \cdot d^{-1}$ by adding Y-rich mischmetal into AZ31. The corrosion rate of AZ91 alloy is about 1.58 $mg \cdot cm^{-2} \cdot d^{-1}$. The patent application No. CN200910248685.0 discloses a magnesium alloy with corrosion resistance, wherein the corrosion rate thereof is remarkably reduced to as low as 0.64 $mg \cdot cm^{-2} \cdot d^{-1}$ by adding a certain amount of Cd into AZ91. The patent application No. CN201410521001.0 discloses a magnesium alloy with corrosion resistance, wherein the corrosion rate thereof can reach to as low as 0.54 $mg \cdot cm^{-2} \cdot d^{-1}$ by adding V element into AZ91. The corrosion rate of the rare-earth containing magnesium alloy is lower, and the corrosion rate of WE43 alloy is about 0.6 $mg \cdot cm^{-2} \cdot d^{-1}$. The patent application No. CN200910099330.X discloses a Mg—Nd—Gd—Zn—Zr alloy with CaO added therein, wherein the corrosion rate thereof can be as low as 0.16 $mg \cdot cm^{-2} \cdot d^{-1}$, but after T6 treatment, the strength thereof is poor, and the high cost also limits its application and development.

Furthermore, the fracture toughness of the magnesium alloy is generally low.

SUMMARY OF INVENTION

In order to overcome the problem of increased rare earth content and insufficient overall performance of the current high-strength magnesium alloy, the present disclosure herein provides, in embodiments, Mg—Gd—Y—Zn—Zr alloys with low rare-earth content and high strength, high toughness, and improved anti-flammability and corrosion resistance. In addition, included herein is a process for preparing the same. The total content of rare earth is not more than 11 weight percent. The process, in embodiments, is relatively simple, the operation is relatively easy, and the cost is low, so that the known problems of complicated preparation processes and high preparation costs for the alloys is overcome.

Objects herein, in embodiments, are achieved by the technical solutions as follows.

A Mg—Gd—Y—Zn—Zr alloy with high strength and toughness, corrosion resistance and anti-flammability, wherein the components and the mass percentages thereof in the alloy are: Gd from 3.0% to 9.0%, Y from 0.8% to 6.0%, such as Y from 1.0% to 6.0%, Gd+Y less than or equal to 11.0%, Zn from 0.5% to 3.0%, Zr from 0.2% 1.5%, and the balance being Mg and inevitable impurities.

A process for preparing the aforementioned Mg—Gd—Y—Zn—Zr alloy with high strength and toughness, corrosion resistance and anti-flammability, specifically carried out by steps of:

(1) calculating and burdening according to the alloy composition, wherein the raw materials Gd, Y and Zr are added in the form of master alloys of Mg-30 wt. % Gd, Mg-30 wt. % Y and Mg-30 wt. % Zr, respectively, and Mg and Zn are added in the form of industrially pure Mg and pure Zn, respectively;

(2) increasing the temperature of a smelting furnace to 760-850° C., adding the pure Mg and pure Zn prepared in step 1 into the smelting furnace under the protection of mixed gases of $CO_2$+10 vol % $SF_6$;

(3) reducing the temperature of the furnace to from 730 to 780° C. after the pure Mg and pure Zn added in step (2) are completely melted, adding the Mg—Gd master alloy, the Mg—Y master alloy, and the Mg—Zr master alloy in this order, to obtain a melt;

(4) adjusting the temperature of the furnace to from 700 to 750° C., removing the slag on the surface of the melt, refining the melt for from 10 to 20 minutes by introducing preheated argon at the bottom of the furnace, to improve the purity of the melt;

(5) increasing the temperature to from 730 to 760° C., transferring the melt into a holding furnace under the pressure of 0.01 to 0.02 MPa, and holding for from 1 to 3 hours; and (6) reducing the temperature to from 700 to 720° C., casting the melt prepared in step (5) at a rate of 42 mm/min, cooling and crystalizing the cast ingot with cooling water at room temperature and a pressure of 0.02 MPa, to finally obtain a large ingot of the Mg—Gd—Y—Zn—Zr alloy with a diameter of 170 mm and a length ≥2.5 m by casting;

(7) conducting a homogenization treatment on the ingot at a temperature of from 450 to 550° C. for from 8 to 24 hours, and then quenching in warm water at 50-80° C.;

(8) conducting an indirect extrusion on the ingot after the homogenization treatment, wherein the extrusion temperature is controlled at from 350 to 450° C., the extrusion ratio is from 8 to 20, and the rain speed is from 0.05 to 5 mm/s; and (9) conducting an isothermal aging treatment on the extruded alloy at from 175 to 225° C. for a holding time of from 0.5 to 200 hours, quenching and cooling the sample in warm water at from 50 to 80° C. after the aging treatment, to obtain the target alloy.

The alloy herein has the following desired properties.

1. The alloy processes herein can produce a magnesium alloy with high strength and toughness and low rare earth content by employing conventional preparation processes. The extrusion process is simple and easy to operate, in embodiments, and has a wide application range.

2. The Mg—Gd—Y—Zn—Zr alloy not only has excellently high strength and toughness, in embodiments, but also has excellent corrosion resistance and flame retardant property. As compared with the commonly used commercial magnesium alloys such as AZ91, ZK60 and WE43, the overall performance thereof has a significant improvement, in embodiments.

3. When the total amount of rare earth in the Mg—Gd—Y—Zn—Zr alloys is from 7 to 11 wt %, the alloy has a tensile strength of 428 MPa or higher, a yield strength of 409 MPa or higher, an elongation 10.1% or higher, a fracture toughness (Kq value) of 21.3 $MPa \cdot m^{1/2}$ or higher, a corrosion rate in the salt spray test (3.5% NaCl) of 0.56 $mg \cdot cm^{-2} \cdot d^{-1}$ or higher, and an ignition point of 708° C. or higher.

4. Both the fracture toughness and the corrosion resistance of the Mg—Gd—Y—Zn—Zr alloy are better than those of WE43 alloy, while the flame retardant property thereof is equivalent to that of WE43 alloy.

DETAILED DESCRIPTION OF THE INVENTION

The technical solution of the alloys and processes herein will be further described below by referring to the Examples. However, the alloys and processes herein are not limited thereto, and any modifications or equivalent alternatives of the technical solution of the present disclosure, without departing from the spirit and scope of the technical solution of the disclosure herein, should be included in the scope of the disclosure herein.

EXAMPLE 1

In the Example, the components and the mass percentages thereof contained in the Mg—Gd—Y—Zn—Zr alloy with high strength are: Gd 8.0%, Y 3.0%, Zn 1.0%, Zr 0.5%, and the balance being Mg and inevitable impurity elements. The specific preparation method for the alloy is carried out according to the following steps:

1. weighing pure Mg, pure Zn, Mg—Y master alloy, Mg—Gd master alloy and Mg—Zr master alloy according to the ratio of 8% Gd, 3% Y, 1% Zn, 0.5% Zr and the balance of Mg based on mass percentage;

2. heating the smelting furnace to 800° C., adding the pure Mg and pure Zn prepared in step 1 into the smelting furnace under the protection of mixed gases of $CO_2$+10 vol % $SF_6$;

3. reducing the temperature of the furnace to 760° C. after the pure Mg and pure Zn are completely melted, adding the Mg—Gd master alloy, the Mg—Y master alloy, and the Mg—Zr master alloy in this order, to obtain a melt;

4. reducing the furnace temperature to 740° C., removing the slag on the surface of the melt, refining the melt for 15 minutes by introducing preheated argon at the bottom of the furnace, to improve the purity of the melt;

5. increasing the temperature to 750° C., transferring the melt into a holding furnace under a pressure of 0.02 MPa, and holding for 2 hours, 6. reducing the temperature to 705° C., casting the melt prepared in step 5 at a rate of 42 mm/min, cooling and crystalizing the cast ingot with cooling water at room temperature and a pressure of 0.02 MPa, to finally obtain a large ingot of the Mg—Gd—Y—Zn—Zr alloy with a diameter of 170 mm and a length of 2.75 m by casting;

7. conducting a homogenization treatment on the ingot at 500° C. for 12 hours, then quenching in warm water at 80° C.;

8. conducting an indirect extrusion on the ingot after the homogenization treatment, wherein the extrusion temperature is controlled at 390° C., the extrusion ratio is 12:1, and the rain speed is 0.1 mm/s; and 9. conducting an isothermal aging treatment on the extruded alloy at 200° C. for 72 hours, and quenching the sample in warm water at 80° C. after the aging treatment, to obtain the target alloy.

The resultant alloy of the Example has a tensile strength of 465 MPa, a yield strength of 437 MPa, and an elongation of 10.8%. See Table 1 for details.

EXAMPLE 2

In the Example, the components and the mass percentages thereof contained in the Mg—Gd—Y—Zn—Zr alloy with high strength are: Gd 8.4%, Y 2.4%, Zn 0.6%, Zr 0.4%, and the balance being Mg and inevitable impurity elements. The preparation method of the Mg—Gd—Y—Zn—Zr alloy with high strength is: firstly, weighing pure Mg, pure Zn, Mg—Y master alloy, Mg—Gd master alloy and Mg—Zr master alloy according to the ratio of 8.4% Gd, 2.4% Y, 0.6% Zn, 0.4% Zr and the balance of Mg based on mass percentage; casting the alloy according to steps 2-6 in Example 1; conducting the homogenization treatment on the ingot at 500° C. for 12 hours, then quenching in the warm water at about 80° C.; conducting the indirect extrusion on the ingot after the homogenization treatment, wherein the extrusion temperature is controlled at 400° C., the extrusion ratio is 12:1, and the rain speed is 0.1 mm/s; conducting the isothermal aging treatment on the extruded alloy at 200° C. for 118 hours, and quenching the sample in the warm water at 80° C. after the aging treatment, to obtain the target alloy. The properties of the alloy are shown in Table 1.

EXAMPLE 3

In the Example, the components and the mass percentages thereof contained in the Mg—Gd—Y—Zn—Zr alloy with high strength are: Gd 6.7%, Y 1.3%, Zn 0.6%, Zr: 0.5%, and the balance being Mg and inevitable impurity elements. The preparation method of the Mg—Gd—Y—Zn—Zr alloy with high strength is: firstly, weighing pure Mg, pure Zn, Mg—Y master alloy, Mg—Gd master alloy and Mg—Zr master alloy according to the ratio of 6.7% Gd, 1.3% Y, 0.6% Zn, 0.5% Zr and the balance of Mg based on mass percentage; casting the alloy according to steps 2-6 in Example 1; conducting the homogenization treatment on the ingot at 510° C. for 8 hours, then quenching in the warm water at about 80° C.; conducting the indirect extrusion on the ingot after the homogenization treatment, wherein the extrusion temperature is controlled at 400° C., the extrusion ratio is 12:1, and the ram speed is 0.1 mm/s; conducting the isothermal aging treatment on the extruded alloy at 200° C. for 84 hours, and quenching the sample in the warm water at 80° C. after the aging treatment, to obtain the target alloy. The properties of the alloy are shown in Table 1.

EXAMPLE 4

In the Example, the components and the mass percentages thereof contained in the Mg—Gd—Y—Zn—Zr alloy with high strength are: Gd 8.4%, Y 0.8%, Zn 0.7%, Zr 0.6%, and the balance being Mg and inevitable impurity elements. The preparation method of the Mg—Gd—Y—Zn—Zr alloy with high strength is: firstly, weighing pure Mg, pure Zn, Mg—Y master alloy, Mg—Gd master alloy and Mg—Zr master alloy according to the ratio of 8.4% Gd, 0.8% Y, 0.7% Zn, 0.6% Zr and the balance of Mg based on mass percentage; casting the alloy according to steps 2-6 in Example 1; conducting the homogenization treatment on the ingot at 510° C. for 8 hours, then quenching in the warm water at about 80° C.; conducting the indirect extrusion on the ingot after the homogenization treatment, wherein the extrusion temperature is controlled at 400° C., the extrusion ratio is 12:1, and the ram speed is 0.1 mm/s; conducting the isothermal aging treatment on the extruded alloy at 200° C. for 84 hours, and quenching the sample in the warm water at 80° C. after the aging treatment, to obtain the target alloy. The properties of the alloy are shown in Table 1.

EXAMPLE 5

In the Example, the components and the mass percentages thereof contained in the Mg—Gd—Y—Zn—Zr alloy with high strength are: Gd 7.1%, Y 2.0%, Zn 1.1%, Zr 0.5%, and the balance being Mg and inevitable impurity elements. The preparation method of the Mg—Gd—Y—Zn—Zr alloy with high strength is: firstly, weighing pure Mg, pure Zn, Mg—Y master alloy, Mg—Gd master alloy and Mg—Zr master alloy according to the ratio of 7.1% Gd, 2.0% Y, 1.1% Zn, 0.5% Zr and the balance of Mg based on mass percentage; casting the alloy according to steps 2-6 in Example 1; conducting the homogenization treatment on the ingot at 510° C. for 8 hours, then quenching in the warm water at about 80° C.; conducting the indirect extrusion on the ingot after the homogenization treatment, wherein the extrusion temperature is controlled at 400° C., the extrusion ratio is 12:1, and the ram speed is 0.1 mm/s; conducting the isothermal aging treatment on the extruded alloy at 200° C. for 84 hours, and quenching the sample in the warm water at 80° C. after the aging treatment, to obtain the target alloy. The properties of the alloy are shown in Table 1.

TABLE 1

The properties of the alloys in the Examples and WE43 (comparative sample)

| | UTS (MPa) | YS (MPa) | ε (%) | Kq (MPa-m$^{1/2}$) | Weight loss in salt spray test mg · (cm$^{-2}$ · d$^{-1}$) | Ignition point (° C.) |
|---|---|---|---|---|---|---|
| Example 1 | 465 | 437 | 10.8 | 31.2 | 0.32 | 748 |
| Example 2 | 455 | 425 | 10.2 | 25.1 | 0.37 | 722 |
| Example 3 | 428 | 409 | 10.1 | 21.6 | 0.50 | 728 |

TABLE 1-continued

The properties of the alloys in the Examples and WE43 (comparative sample)

| | UTS (MPa) | YS (MPa) | ε (%) | Kq (MPa-m$^{1/2}$) | Weight loss in salt spray test mg · (cm$^{-2}$ · d$^{-1}$) | Ignition point (° C.) |
|---|---|---|---|---|---|---|
| Example 4 | 436 | 422 | 11.3 | 21.3 | 0.56 | 746 |
| Example 5 | 451 | 423 | 10.7 | 22.4 | 0.37 | 708 |
| WE43 | 352 | 243 | 11.5 | 15.0 | 0.61 | 765 |

The present invention obtains a wrought magnesium alloy having superior overall performances with a small amount of rare earth element by adjusting the proportion of the alloy elements and by conventional casting, extrusion and heat treatment processes. At room-temperature, the tensile strength thereof is 428-465 MPa, the yield strength is 409-437 MPa, and the elongation is 10.1%-14.4%; meanwhile, it also has excellent fracture toughness, corrosion resistance and flame retardant property. The cost of the alloy is reduced while the strength of the alloy is maintained.

The invention claimed is:

1. A process for preparing a Mg—Gd—Y—Zn—Zr alloy, characterized in that the process comprises:

(1) providing Gd, Y and Zr in the form of master alloys of Mg-30 wt. % Gd, Mg-30 wt. % Y and Mg-30 wt. % Zr, respectively, and providing Mg and Zn;

(2) increasing a first temperature of a smelting furnace to a second temperature of 760 to 850° C., adding the Mg and Zn of (1) into the smelting furnace under protection of mixed gases of $CO_2$+10 vol % $SF_6$;

(3) reducing the second temperature to a third temperature of the smelting furnace of 730 to 780° C. after the Mg and Zn added in (2) are completely melted, adding the Mg—Gd master alloy, the Mg—Y master alloy, and the Mg—Zr master alloy in this order, to obtain a melt;

(4) adjusting the third temperature to a fourth temperature of a smelting furnace of 700 to 750° C., removing slag on a surface of the melt, refining the melt for 10 to 20 minutes by introducing preheated argon at a bottom of the smelting furnace;

(5) increasing the fourth temperature to a fifth temperature of 730 to 760° C., transferring the melt into a holding furnace under the pressure of 0.01 to 0.02 MPa, and holding for 1 to 3 hours; and (6) reducing the fifth temperature to a sixth temperature of 700 to 720° C., casting the melt prepared in (5), and cooling and crystalizing a cast ingot with cooling water at room temperature to obtain an ingot of the Mg—Gd—Y—Zn—Zr alloy having a length 2.5 m or more by casting, wherein the components and the mass percentages of the Mg—Gd—Y—Zn—Zr alloy comprise from 3% to 9% Gd, from 0.8% to 6% Y, from 0.5% to 3% Zn, from 0.2% to 1.5% Zr, the balance being Mg and inevitable impurities.

2. The process for preparing the Mg—Gd—Y—Zn—Zr alloy according to claim 1, wherein casting the melt prepared in (5) is performed at a casting rate of 42 mm/min, and cooling and crystalizing the cast ingot with cooling water is performed at a pressure of the cooling water of 0.02 MPa.

3. The process for preparing the Mg—Gd—Y—Zn—Zr alloy according to claim 1, wherein the process further comprises:

(7) conducting a homogenization treatment on the ingot of the Mg—Gd—Y—Zn—Zr alloy at a temperature of 450 to 550° C. for 8 to 24 hours, and then quenching the ingot in water having a temperature of 50 to 80° C.;

(8) conducting an indirect extrusion on the ingot after the homogenization treatment to form an extruded alloy, wherein the extrusion temperature is controlled at a temperature of 350 to 450° C., an extrusion ratio is 8 to 20, and a ram speed is 0.05-5 mm/s; and (9) conducting an isothermal aging treatment on the extruded alloy at a temperature of 175 to 225° C. for a holding time of 0.5 to 200 hours to form an aged alloy, and quenching and cooling the aged alloy in water at a temperature of 50 to 80° C. to obtain the Mg—Gd—Y—Zn—Zr alloy.

4. The process for preparing the Mg—Gd—Y—Zn—Zr alloy according to claim 1, wherein Gd+Y is 11.0% or less of the Mg—Gd—Y—Zn—Zr alloy.

5. The process for preparing the Mg—Gd—Y—Zn—Zr alloy according to claim 1, wherein the process further comprises:

(7) conducting a homogenization treatment on the large ingot of the Mg—Gd—Y—Zn—Zr alloy at a temperature of 450 to 550° C. for 8 to 24 hours, and then quenching in water having a temperature of 50 to 80° C.

6. The process for preparing the Mg—Gd—Y—Zn—Zr alloy according to claim 5, wherein the process further comprises:

(8) conducting an indirect extrusion on the large ingot after the homogenization treatment, wherein the extrusion temperature is controlled at a temperature of 350 to 450° C., an extrusion ratio is 8 to 20, and a ram speed is 0.05-5 mm/s.

7. The process according to claim 1, wherein the alloy comprises 8.0% Gd, 3.0% Y, 1.0% Zn, 0.5% Zr, the balance being Mg and inevitable impurities.

8. The process according to claim 1, wherein the alloy comprises Gd: 8.4%, Y: 2.4%, Zn: 0.6%, Zr: 0.4%, the balance being Mg and inevitable impurities.

9. The process according to claim 1, wherein the alloy comprises Gd: 6.7%, Y: 1.3%, Zn: 0.6%, Zr: 0.5%, the balance being Mg and inevitable impurities.

10. The process according to claim 1, wherein the alloy comprises Gd: 8.4%, Y: 1%, Zn: 0.7%, Zr: 0.6%, the balance being Mg and inevitable impurities.

11. The process according to claim 1, wherein the alloy comprises Gd: 7.1%, Y: 2.0%, Zn: 1.1%, Zr: 0.5%, the balance being Mg and inevitable impurities.

12. The process according to claim 1, wherein the second temperature is 760° C.

13. The process according to claim 1, wherein the ingot of the Mg—Gd—Y—Zn—Zr alloy has a diameter of 170 mm.

14. The process according to claim 1, wherein the alloy comprises 8.0% Gd.

15. The process according to claim 1, wherein the alloy comprises 3.0% Y.

16. The process according to claim 1, wherein the alloy comprises 1.0% Zn.

17. The process according to claim 1, wherein the alloy comprises 0.5% Zr.

18. The process according to claim 1, wherein the alloy comprises 8.4% Gd.

19. The process according to claim 1, wherein the alloy comprises 2.4% Y.

20. The process according to claim 1, wherein the alloy comprises 0.6% Zn.

21. The process according to claim 1, wherein the alloy comprises 0.4% Zr.

* * * * *